US010323611B2

(12) United States Patent
Kassai et al.

(10) Patent No.: US 10,323,611 B2
(45) Date of Patent: Jun. 18, 2019

(54) FUEL FEEDING PIPE PROTECTION STRUCTURE

(71) Applicant: HONDA MOTOR CO., LTD., Tokyo (JP)

(72) Inventors: Hiroki Kassai, Wako (JP); Koji Sato, Wako (JP); Kazushi Kimura, Wako (JP)

(73) Assignee: HONDA MOTOR CO., LTD., Tokyo ( * ) Notice: Subject to any disclaimer, the term of this patent is extended or adjusted under 35 U.S.C. 154(b) by 0 days.

(21) Appl. No.: 15/902,137

(22) Filed: Feb. 22, 2018

(65) Prior Publication Data

US 2018/0245556 A1 Aug. 30, 2018

(30) Foreign Application Priority Data

Feb. 24, 2017 (JP) ..... 2017-033585

(51) Int. Cl.
*F02M 37/00* (2006.01)
*F02M 35/104* (2006.01)
*F02B 77/08* (2006.01)

(52) U.S. Cl.
CPC ..... *F02M 37/0017* (2013.01); *F02M 35/104* (2013.01); *F02B 77/08* (2013.01); *F02M 37/007* (2013.01)

(58) Field of Classification Search
CPC ..... F02M 37/0017; F02M 35/104; F02M 37/007; F02B 77/08
See application file for complete search history.

(56) References Cited

U.S. PATENT DOCUMENTS 6,189,510 B1 * 2/2001 Jaeger ..... F02M 55/02 123/198 D
2004/0159302 A1 * 8/2004 Horibe ..... F02M 35/10078 123/195 C

FOREIGN PATENT DOCUMENTS

EP 2397356 A1 * 12/2011 ..... B66C 1/107
JP 2004-245147 A 9/2004
JP 2006-46330 A 2/2006
JP 2007-239710 A 9/2007
WO 2009/139081 A1 11/2009

OTHER PUBLICATIONS

Office Action dated Jul. 4, 2018, issued in counterpart Japanese application No. 2017-033585, with English translation (4 pages).

* cited by examiner

*Primary Examiner* — Hung Q Nguyen
(74) *Attorney, Agent, or Firm* — Westerman, Hattori, Daniels & Adrian, LLP

(57) ABSTRACT

A protection member fixed to an engine main body to protect a fuel feeding pipe from coming into contact with an intake part includes a first protrusion protruding in an extending direction of the fuel feeding pipe from the vicinity of a first fastening portion, a second protrusion protruding in the same direction as the protruding direction of the first protrusion from the vicinity of a second fastening portion, and a third protrusion protruding in the longitudinal direction from the second protrusion and brought into contact with the engine main body. Hence, load from the intake part is supported by the first and second protrusions in the vicinity of the high-strength first and second fastening portions, and also the load is surely transmitted not only from the first and second fastening portions, but also from the third protrusion to the engine main body.

19 Claims, 7 Drawing Sheets

FUEL FEEDING PIPE PROTECTION STRUCTURE

CROSS REFERENCES TO RELATED APPLICATIONS

The present application claims priority under 35 U.S.C. § 119 to Japanese Patent Application No. 2017-033585, filed Feb. 24, 2017, entitled "FUEL FEEDING PIPE PROTECTION STRUCTURE." The contents of this application are incorporated herein by reference in their entirety.

TECHNICAL FIELD

The present invention relates to a fuel feeding pipe protection structure including: an intake part arranged in such a manner as to face an engine main body in the longitudinal direction; a fuel feeding pipe arranged between the engine main body and the intake part; and a protection member fixed to the engine main body to protect the fuel feeding pipe from coming into contact with the intake part.

BACKGROUND

For example, Japanese Patent Application Publication No. 2007-239710 discloses a structure in which, in order to protect an intake manifold and a fuel system member arranged on a side face of a cylinder head of an internal combustion engine from collision load, the intake manifold and fuel system member are covered with a protector from outside, and a protrusion block provided in the protector faces and is allowed to come into contact with an abutting seat provided in the intake manifold, with a gap formed therebetween.

SUMMARY

The conventional structure not only requires a large and heavy protector that covers most of the side face of the cylinder head, but also requires the protector to have strong rigidity to transmit collision load to the cylinder head, to surely protect the intake manifold and the fuel system member. This leads to a problem of even more increase in weight.

It is preferable to protect a fuel feeding pipe of an internal combustion engine from collision load, with a protection member having a light and simple structure.

First aspect of the present disclosure provides a fuel feeding pipe protection structure including: an intake part arranged in such a manner as to face an engine main body in a longitudinal direction; a fuel feeding pipe arranged between the engine main body and the intake part; and a protection member fixed to the engine main body to protect the fuel feeding pipe from coming into contact with the intake part, wherein the protection member includes a first fastening part and a second fastening part fastened to the engine main body, a bridging part connecting the first fastening part and the second fastening part and interposed between the intake part and the fuel feeding pipe, a first protrusion protruding in an extending direction of the fuel feeding pipe from the vicinity of the first fastening part, a second protrusion protruding in the same direction as the protruding direction of the first protrusion from the vicinity of the second fastening part, and a third protrusion protruding in the longitudinal direction from the second protrusion and brought into contact with the engine main body.

According to another aspect, the intake part includes a handle member fixed to an outer peripheral part of an intake manifold; and when viewed in the longitudinal direction, the handle member overlaps and is allowed to come into contact with a bolt that fastens any one of the first fastening part and the second fastening part to the engine main body.

Note that the cylinder head 11 of the embodiment corresponds to the engine main body of the present disclosure, for example, and the stud bolt 27 of the embodiment corresponds to the bolt of the present disclosure, for example.

According to the first aspect, the protection member fixed to the engine main body includes the first fastening part and the second fastening part fastened to the engine main body, and the bridging part connecting the first fastening part and the second fastening part and interposed between the intake part and the fuel feeding pipe. Hence, when the intake part is moved toward the engine main body by collision load of the vehicle, the intake part collides with the protection member and does not collide with the fuel piping. This can prevent damage in the fuel feeding pipe. In particular, the protection member includes the first protrusion protruding in the extending direction of the fuel feeding pipe from the vicinity of the first fastening part, the second protrusion protruding in the same direction as the protruding direction of the first protrusion from the vicinity of the second fastening part, and a third protrusion protruding in the longitudinal direction from the second protrusion and brought into contact with the engine main body. Hence, load from the intake part is supported by the first and second protrusions in the vicinity of the high-strength first and second fastening portions, and also the load is surely transmitted not only from the first and second fastening portions, but also from the third protrusion to the engine main body. Accordingly, transmission of collision load to the fuel feeding pipe can be prevented with the protection member having a light and simple structure, and damage in the fuel feeding pipe can be more surely prevented.

According to the another aspect, the intake part includes the handle member fixed to the outer peripheral part of the intake manifold, and when viewed in the longitudinal direction, the handle member overlaps and is allowed to come into contact with a bolt that fastens any one of the first fastening part and the second fastening part to the engine main body. Hence, by transmitting collision load from the high-strength handle member to the protection member at three points, which are the first protrusion, the second protrusion, and the bolt, fuel piping can be protected even more surely.

DETAILED DESCRIPTION

Hereinafter, an embodiment of the present disclosure will be described with reference to FIGS. 1 to 7. Note that in the specification, the longitudinal direction and lateral direction are defined on the basis of an occupant seated in a driver's seat.

Figure 1:
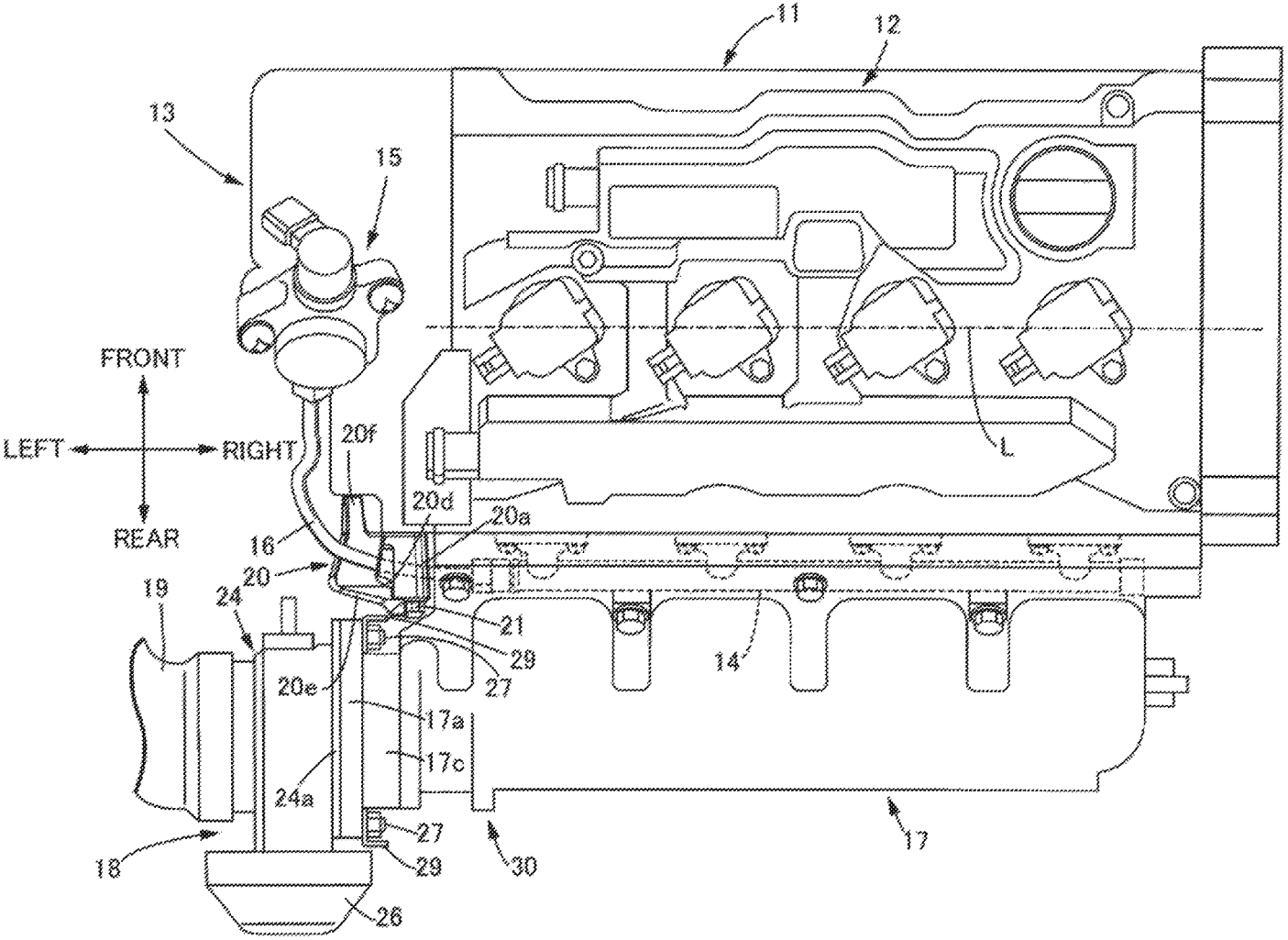
FIG. 1 is a top view of an inline four-cylinder internal combustion engine.
Figure 2:
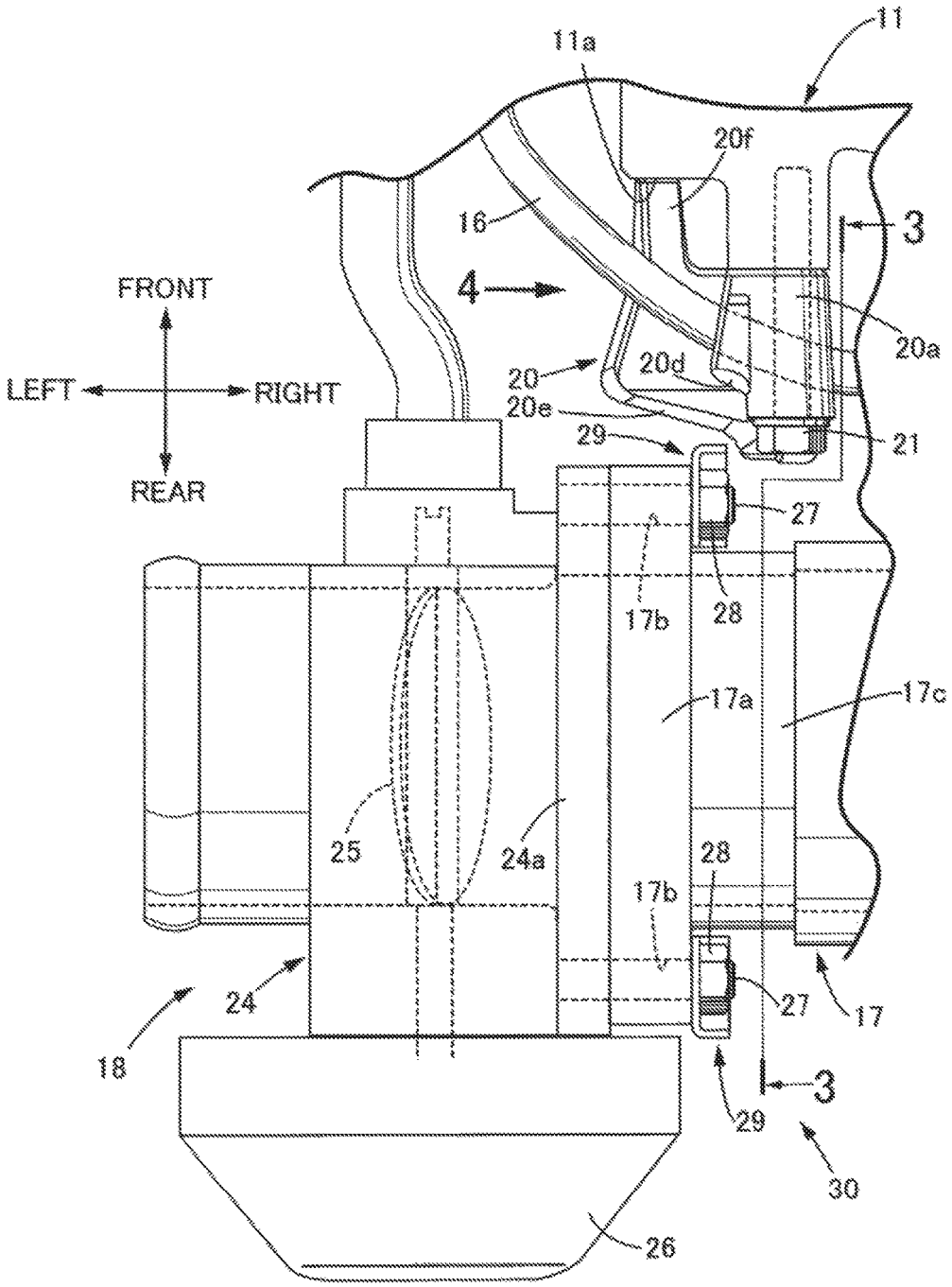
FIG. 2 is an enlarged view of a main part of FIG. 1.
Figure 3:
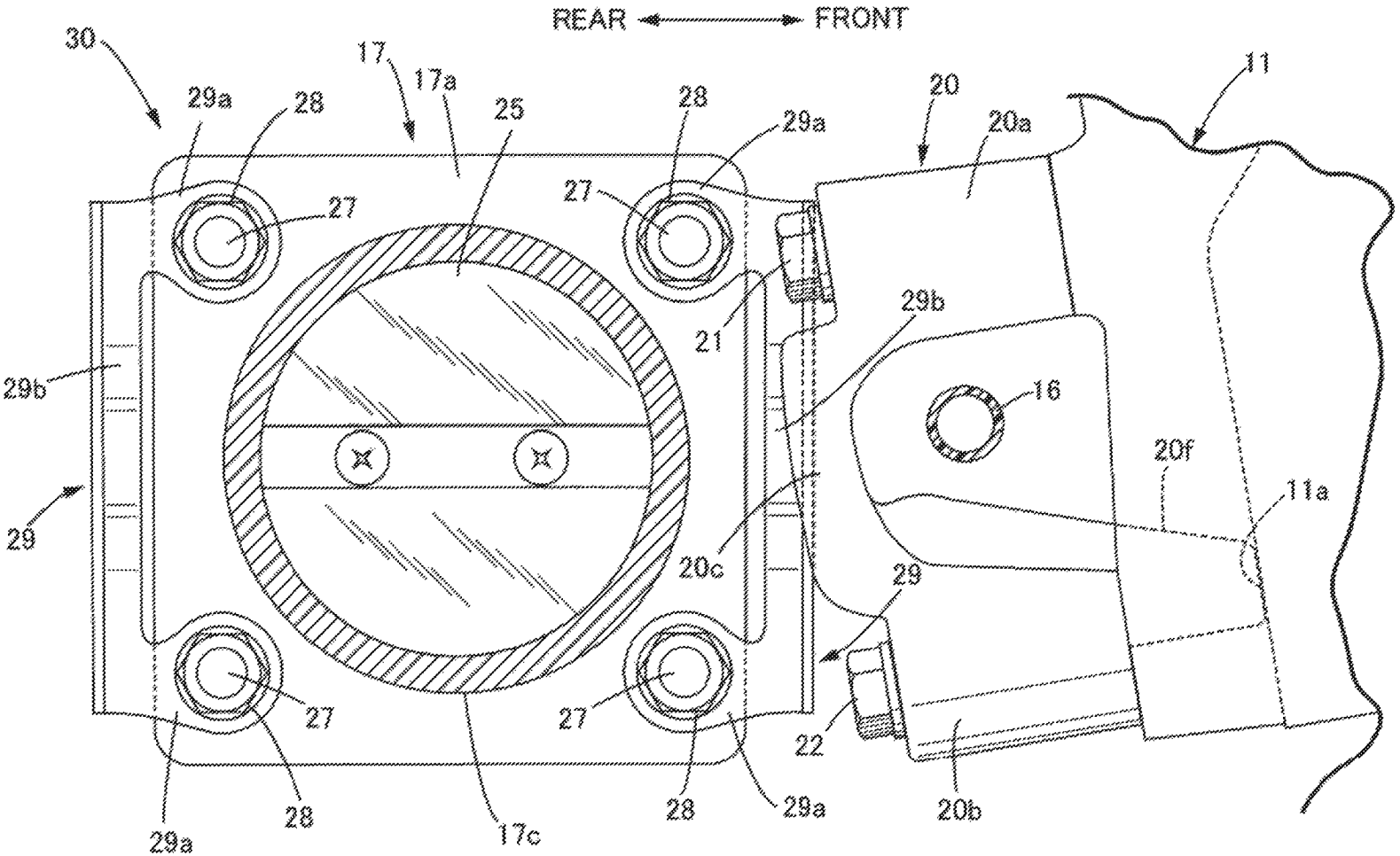
FIG. 3 is a cross-sectional view taken along line 3-3 of FIG. 2.
Figure 4:
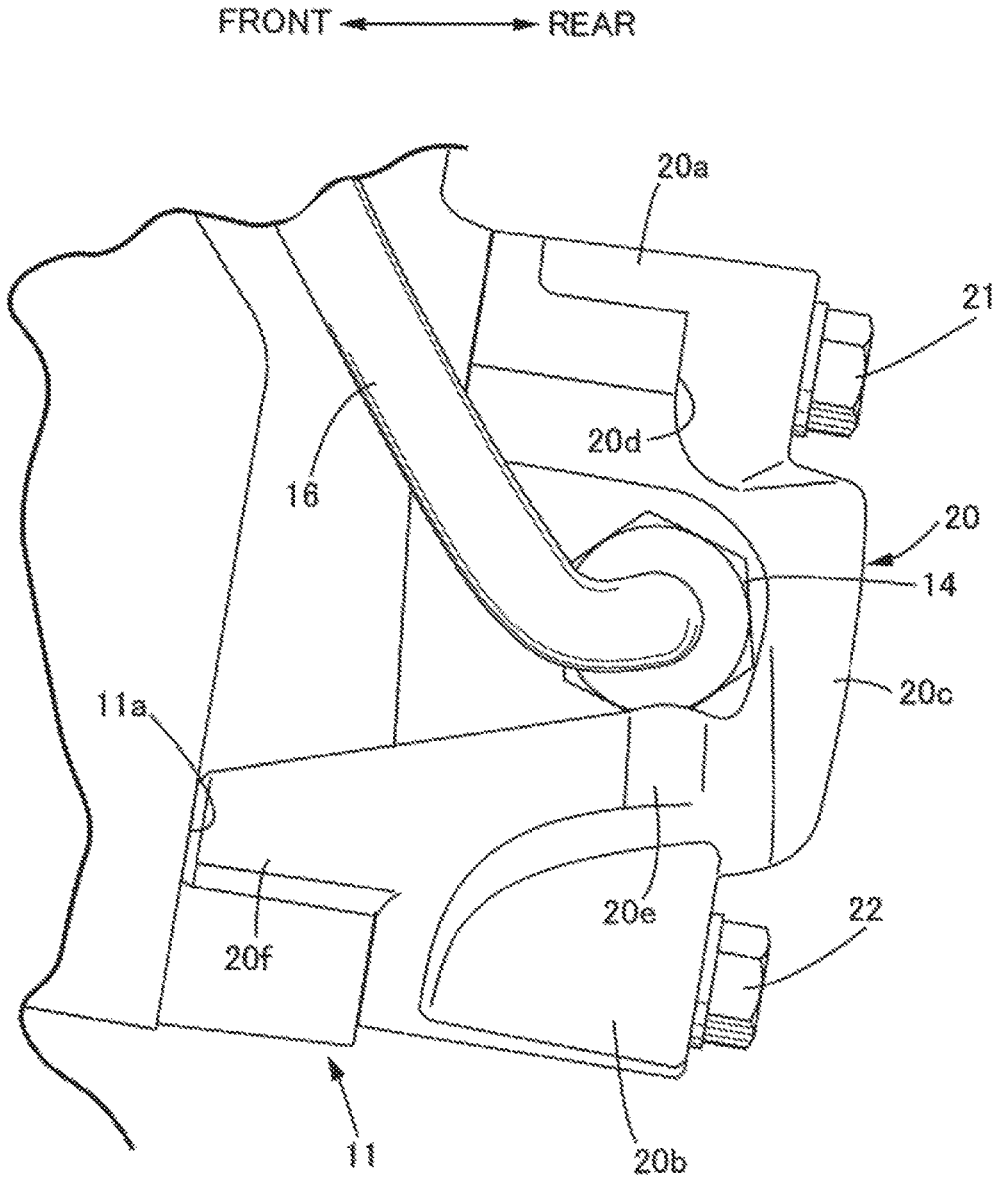
FIG. 4 is an arrow view in direction 4 of FIG. 2.
Figure 5A:
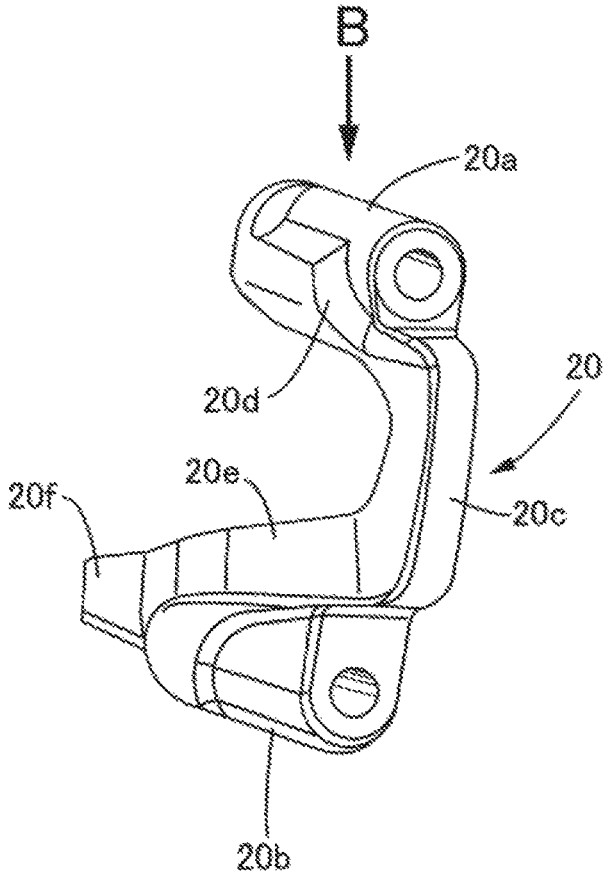
FIG. 5A and FIG. 5B are each a unit drawing of a protection member.
Figure 5B:
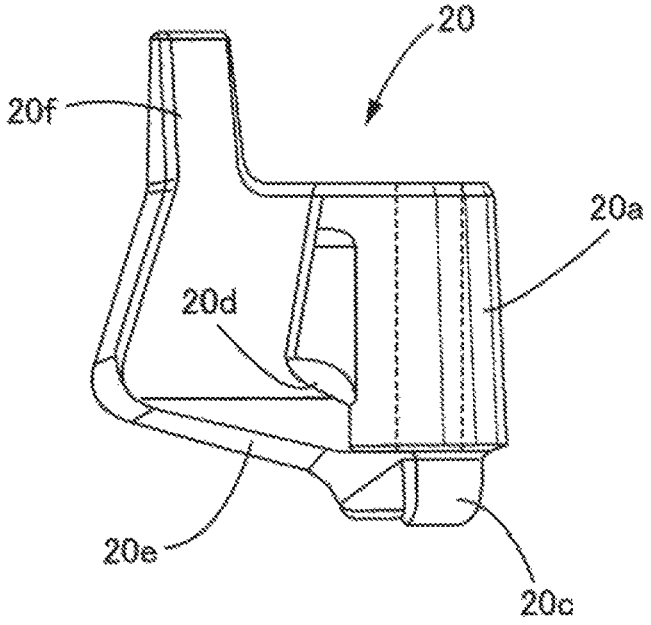

FIG. 1 is a top view of an inline four-cylinder internal combustion engine for a vehicle. A head cover 12 and a high pressure pump base 13 are coupled to an upper face of a cylinder head 11 that constitutes an engine main body of the present disclosure. A fuel delivery pipe 14 is arranged along a cylinder bank line L direction on a rear face of the cylinder head 11. A high pressure fuel pump 15 supported by the high pressure pump base 13, and a left end of the fuel delivery pipe 14 are connected by a fuel feeding pipe 16. A synthetic resin intake manifold 17 is arranged along the back of the fuel delivery pipe 14, a drive-by-wire throttle valve 18 is connected to a left end of the intake manifold 17, and intake piping 19 is connected to the upstream side of the throttle valve 18. A protection member 20 for protecting the fuel feeding pipe 16 from collision load is provided on a left end rear face of the cylinder head 11.

As illustrated in FIGS. 2 to 5B, the protection member 20 is an aluminum alloy cast member, and includes a cylindrical first fastening portion 20*a* positioned at the upper end and extending in the longitudinal direction, a cylindrical second fastening portion 20*b* positioned at the lower end and extending in the longitudinal direction, and a bridging portion 20*c* that connects the first fastening portion 20*a* and the second fastening portion 20*b* in the vertical direction. The protection member 20 is fastened to a left end rear wall of the cylinder head 11, with an upper bolt 21 penetrating the first fastening portion 20*a* in the longitudinal direction and a lower bolt 22 penetrating the second fastening portion 20*b* in the longitudinal direction.

Moreover, the protection member 20 includes a first protrusion 20*d* that protrudes outwardly in a rib shape to the left along the cylinder bank line direction L from the vicinity of the first fastening portion 20*a*, a second protrusion 20*e* that protrudes outwardly in a rib shape to the left along the cylinder bank line direction L from the vicinity of the second fastening portion 20*b*, and a third protrusion 20*f* that protrudes frontward from a front face of the second protrusion 20*e* and is brought into contact with a seating face 11*a* (see FIGS. 2 and 4) formed on a rear face of the cylinder head 11.

When the protection member 20 formed in this manner is fastened to the rear wall of the cylinder head 11 with the upper bolt 21 and the lower bolt 22, a space surrounded by the first fastening portion 20*a*, the bridging portion 20*c*, the second fastening portion 20*b* of the protection member 20, and the rear wall of the cylinder head 11 is formed, and the fuel feeding pipe 16 is inserted into this space.

The throttle valve 18 includes a metal throttle body 24, a valve body 25 arranged inside the throttle body 24, and an electric motor 26 that drives the valve element 25. A square fastening flange 24*a* formed in an outlet end of the throttle body 24 and a square fastening flange 17*a* formed in an inlet end of the intake manifold 17 are brought into contact with each other, and are fastened with four stud bolts 27 protruding from four corners of the fastening flange 24*a* of the throttle body 24 which penetrate bolt holes 17*b* formed in four corners of the fastening flange 17*a* of the intake manifold 17 and are fastened by nuts 28.

The intake manifold 17 includes an annular groove portion 17*c* having a reduced diameter, in a position adjacent to the fastening flange 17*a*. Front and rear steel handle members 29, 29 are attached along the outer periphery of the annular groove portion 17*c*. Each handle member 29 includes a pair of fixed portions 29*a*, 29*a* and a connection portion 29*b* connecting the fixed portions 29*a*, 29*a* and having an L-shaped section. The pair of fixed portions 29*a*, 29*a* are jointly fastened to a side face of the fastening flange 17*a* by use of the two stud bolts 27, 27 and the two nuts 28, 28. A longitudinal center part of the connection portion 29*b* of the handle member 29 is curved in an arc shape that curves away from the fastening flange 17*a* (see FIG. 7).

The front handle member 29 and the rear handle member 29 are formed into longitudinally plane-symmetric shapes, and are arranged in longitudinally plane-symmetric positions. These handle members 29, 29 are provided for a worker to easily hold an end part of the intake manifold 17 during assembly of the internal combustion engine, and have relatively high strength.

The intake manifold 17, throttle valve 18, and handle members 29, 29 constitute an intake part 30 of the present disclosure, for example.

Next, effects of the embodiment of the present disclosure configured in the above manner will be described.

Figure 6:
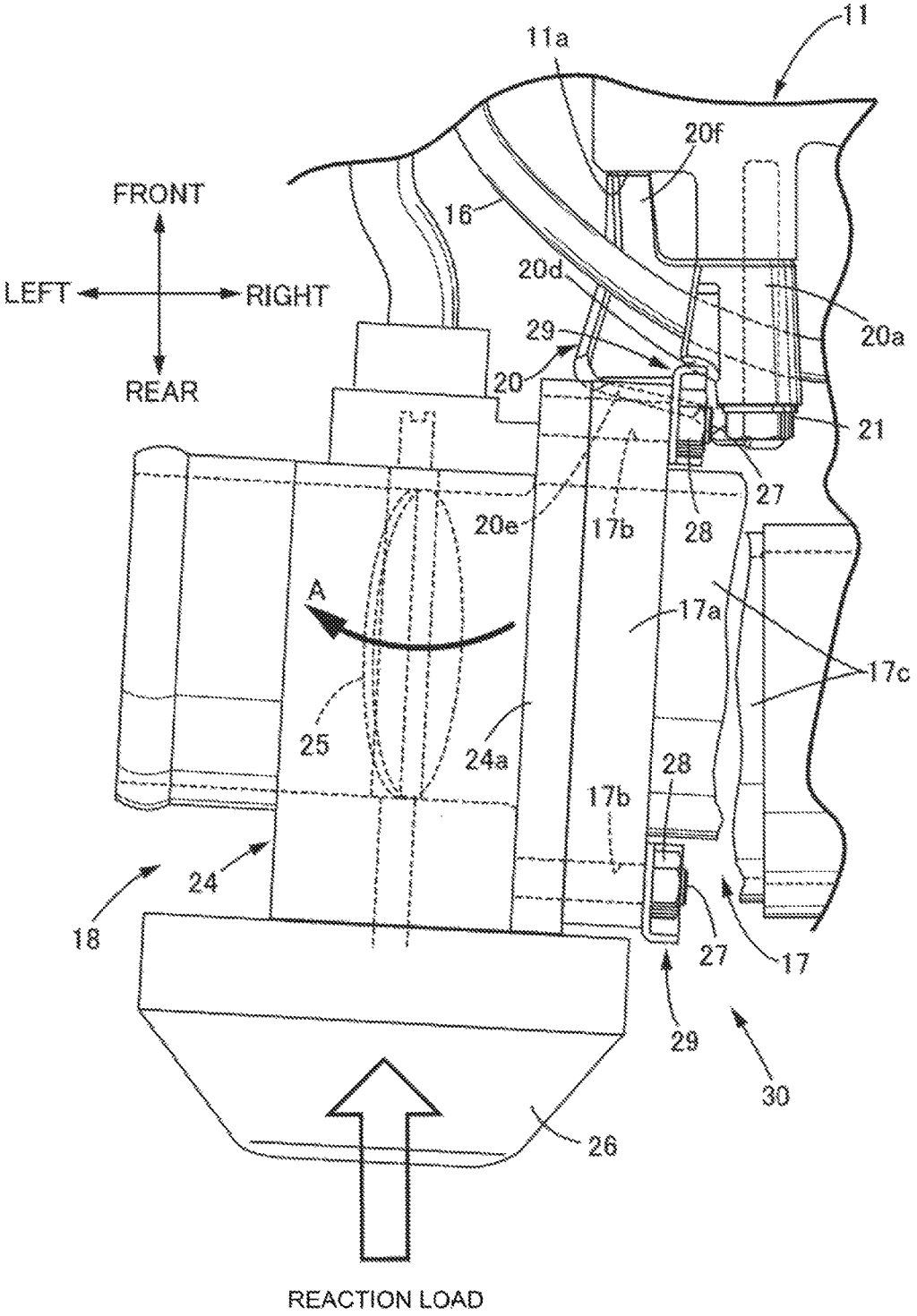
FIG. 6 is an explanatory drawing of action at the time of collision corresponding to FIG. 2.

As illustrated in FIG. 6, when the intake part 30 is pushed rearward with the internal combustion engine by collision load at the time of a frontal crash of the vehicle, the throttle valve 18 that protrudes farthest to the rear in the intake part 30 abuts on a dashboard panel (not shown), whereby a frontward reaction load acts on the throttle valve 18 from the dashboard panel. When the throttle valve 18 is pushed frontward by the reaction load, the relatively weak annular groove portion 17*c* continuous with the fastening flange 17*a* of the synthetic resin intake manifold 17 connected to the throttle valve 18 breaks, and the throttle valve 18 moves further toward the cylinder head 11 while being tilted in arrow A direction in FIG. 6. As a result, of the two handle members 29, 29 left on the throttle valve 18 side, the front handle member 29 abuts on the high-strength protection member 20 attached to the rear face of the cylinder head 11, whereby the throttle valve 18 is kept from moving any further to the front. Hence, it is possible to prevent the throttle valve 18 from abutting on and damaging the fuel feeding pipe 16.

Figure 7:
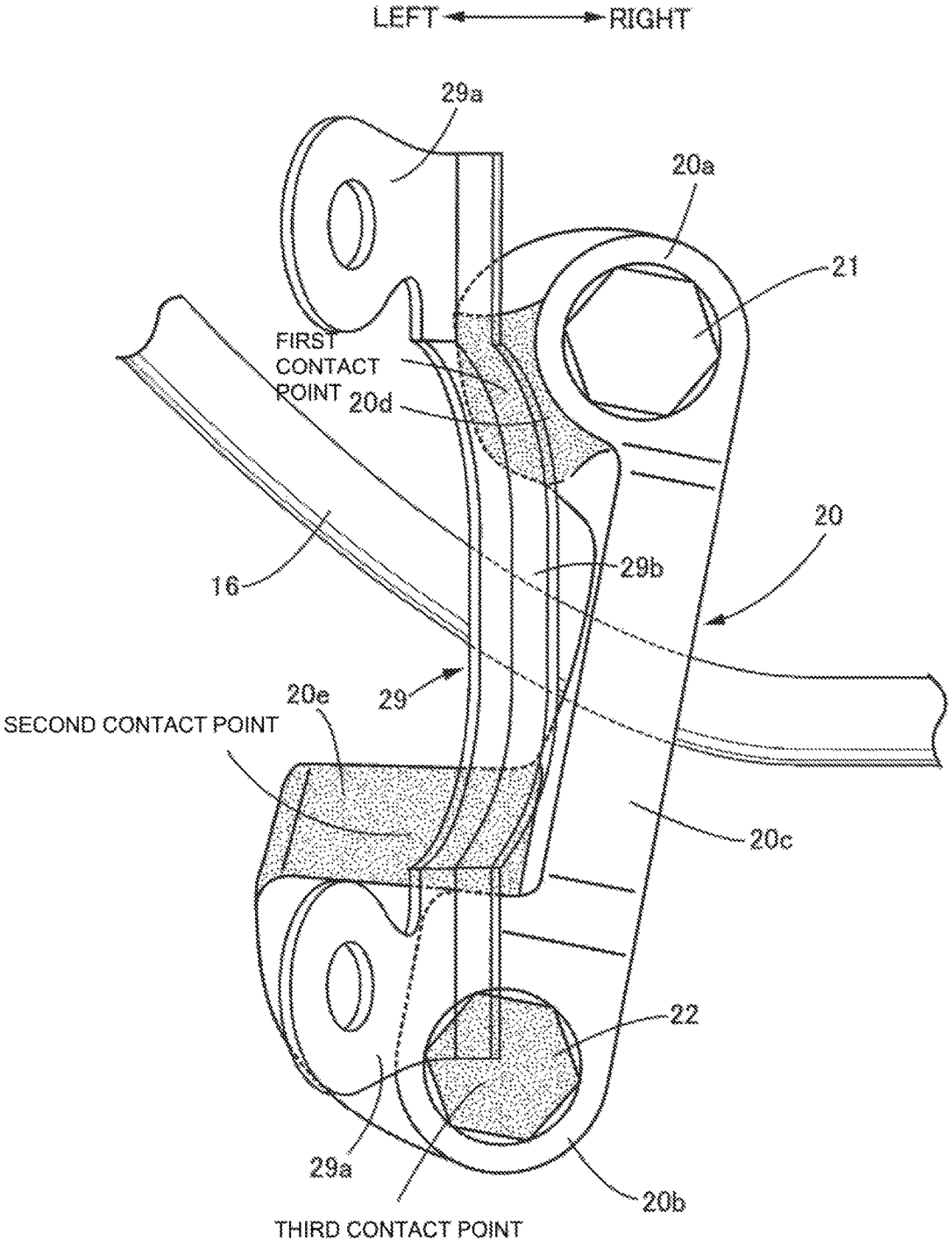
FIG. 7 is an explanatory drawing of first to third contact points of the protection member.

At this time, as illustrated in FIG. 7, the front handle member 29 remaining on the throttle valve 18 side abuts on the protection member 20 positioned at the front thereof, at three points. Specifically, an upper part of the connection portion 29*b* of the handle member 29 abuts on the first protrusion 20*d* in the vicinity of the first fastening portion 20*a* of the protection member 20 at a first contact point, a lower part of the connection portion 29*b* of the handle member 29 abuts on the second protrusion 20*e* in the vicinity of the second fastening portion 20*b* of the protection member 20 at a second contact point, and the lower fixed portion 29*a* of the handle member 29 abuts on a head part of the lower bolt 22 fastening the second fastening portion 20*b* of the protection member 20 at a third contact point. Thus, the reaction load not only is surely transmitted to the cylinder head 11 by being supported by the first protrusion 20*d* and the second protrusion 20*e* in the vicinity of the first fastening portion 20*a* and the second fastening portion 20*b* of the high-strength protection member 20, but also is directly transmitted to the seating face 11*a* of the cylinder head 11 from the third protrusion 20*f*. Hence, it is possible to prevent transmission of the collision load (reaction load from a front bulk head) from the throttle valve 18 to the fuel feeding pipe 16, to surely prevent damage in the fuel feeding pipe 16. Moreover, since the protection member 20 is a small, light and simple-shaped member, increase in weight and cost can be minimized.

In particular, the third contact point of the protection member 20 is a head part of the lower bolt 22 and has high strength, and the lower fixed portion 29*a* where the handle member 29 abuts on the third contact point is also a high-strength part in the vicinity of a fastening part formed of the stud bolt 27 and the nut 28. Hence, it is possible to more surely transmit reaction load from the throttle valve 18 to the cylinder head 11 through the protection member 20, and keep the fuel feeding pipe 16 from being damaged by the reaction load.

Additionally, while the throttle valve 18 moves frontward while being tilted in arrow A direction of FIG. 6 upon breakage of the intake manifold 17, the first protrusion 20*d* and the second protrusion 20*e* of the protection member 20 protrude leftward, which is the direction in which the throttle valve 18 is tilted, from the first fastening portion 20*a* and the second fastening portion 20*b*. Hence, it is possible to more surely bring the handle member 29 into contact with the protection member 20. For example, transmission of collision load to the fuel feeding pipe 16 can be prevented with the protection member 20 having a light and simple structure, and damage in the fuel feeding pipe 16 can be surely prevented.

Although the embodiment of the present invention has been described, various design changes can be made, without departing from the gist of the invention. Although a specific form of embodiment has been described above and illustrated in the accompanying drawings in order to be more clearly understood, the above description is made by way of example and not as limiting the scope of the invention defined by the accompanying claims. The scope of the invention is to be determined by the accompanying claims. Various modifications apparent to one of ordinary skill in the art could be made without departing from the scope of the invention. The accompanying claims cover such modifications.

For example, the engine main body of the present disclosure is not limited to the cylinder head 11 of the embodiment, and may be a cylinder block or a head cover. Although the intake part 30 is arranged on the rear side of the cylinder head 11 in the embodiment, it may be arranged on the front side of the cylinder head 11 instead.

The intake part 30 of the present disclosure is not limited to the intake manifold 17, throttle valve 18, and handle member 29 of the embodiment.

Although the third protrusion 20*f* protrudes from the second protrusion 20*e* in the embodiment, it may protrude from the first protrusion 20*d* instead.

Although the handle member 29 abuts on the lower bolt 22 upon input of collision load in the embodiment, it may abut on the upper bolt 21 instead.

The internal combustion engine to which the present disclosure is applied is not limited to the inline multi-cylinder internal combustion engine of the embodiment, and may be other types of internal combustion engines such as a V-type multi-cylinder internal combustion engine.

Upper and lower sides in the present disclosure are not upper and lower sides in the vertical direction. Instead, the cylinder head 11 side with respect to the crankshaft of the internal combustion engine is defined as the upper side, and the opposite side is defined as the lower side.

The invention claimed is:

1. A fuel feeding pipe protection structure comprising:

an intake part arranged in such a manner as to face an engine main body in a longitudinal direction of a vehicle;

a fuel feeding pipe arranged between said engine main body and said intake part; and a protection member fixed to said engine main body and configured to protect said fuel feeding pipe from coming into contact with said intake part, wherein said protection member comprises:

a first fastening part and a second fastening part fastened to said engine main body, a bridging part connecting said first fastening part and said second fastening part and interposed between said intake part and said fuel feeding pipe, said bridging part extending in a first direction from said first fastening part toward said second fastening part, a first protrusion protruding in an extending direction of said fuel feeding pipe from the vicinity of said first fastening part, said first protrusion protruding in a direction intersecting said first direction, a second protrusion protruding in the same direction as the protruding direction of said first protrusion from the vicinity of said second fastening part, and a third protrusion protruding toward said engine main body and protruding in the longitudinal direction from one of said first protrusion and said second protrusion and brought into contact with said engine main body, wherein said first fastening part and said second fastening part protrude toward said engine main body from said bridging part such that a space is constituted between said bridging part and said engine main body, said fuel feeding pipe being inserted into said space, wherein said first protrusion protrudes as a rib which contacts said engine main body, and said second protrusion protrudes as a rib which contacts said engine main body.

2. The fuel feeding pipe protection structure according to claim 1, wherein:

said intake part includes an intake manifold and a handle member fixed to an outer peripheral part of the intake manifold, and when viewed along the longitudinal direction, said handle member overlaps and is allowed to come into contact with a bolt that fastens any one of said first fastening part and said second fastening part to said engine main body.

3. The fuel feeding pipe protection structure according to claim 1, wherein the third protrusion protrudes in the longitudinal direction from said second protrusion.

4. The fuel feeding pipe protection structure according to claim 1, wherein the protection member is disposed between the intake part and the engine main body.

5. The fuel feeding pipe protection structure according to claim 1, wherein the first fastening part and the second fastening part protrude from the engine main body in the longitudinal direction.

6. The fuel feeding pipe protection structure according to claim 1, wherein the fuel feeding pipe extends in a direction perpendicular to the longitudinal direction.

7. The fuel feeding pipe protection structure according to claim 2, wherein the bolt extends in the longitudinal direction.

8. The fuel feeding pipe protection structure according to claim 2, wherein the intake manifold includes a weak portion weaker against bending force than other portion thereof, and the handle member is disposed on distal end side of the intake manifold with respect to the weak portion.

9. The fuel feeding pipe protection structure according to claim 8, wherein the weak portion is an annular groove.

10. A vehicle comprising the fuel feeding pipe protection structure according to claim 1.

11. A fuel feeding pipe protection structure comprising:

an intake part arranged in such a manner as to face an engine main body in a longitudinal direction of a vehicle;

a fuel feeding pipe arranged between said engine main body and said intake part; and a protection member fixed to said engine main body and configured to protect said fuel feeding pipe from coming into contact with said intake part, wherein said protection member comprises:

a first fastening part and a second fastening part fastened to said engine main body, a bridging part connecting said first fastening part and said second fastening part and interposed between said intake part and said fuel feeding pipe, a first protrusion protruding in an extending direction of said fuel feeding pipe from the vicinity of said first fastening part, a second protrusion protruding in the same direction as the protruding direction of said first protrusion from the vicinity of said second fastening part, and a third protrusion protruding in the longitudinal direction from one of said first protrusion and said second protrusion and brought into contact with said engine main body, wherein:

said intake part includes an intake manifold and a handle member fixed to an outer peripheral part of the intake manifold, and when viewed along the longitudinal direction, said handle member overlaps and is allowed to come into contact with a bolt that fastens any one of said first fastening part and said second fastening part to said engine main body.

12. The fuel feeding pipe protection structure according to claim 11, wherein the third protrusion protrudes in the longitudinal direction from said second protrusion.

13. The fuel feeding pipe protection structure according to claim 11, wherein the protection member is disposed between the intake part and the engine main body.

14. The fuel feeding pipe protection structure according to claim 11, wherein the first fastening part and the second fastening part protrude from the engine main body in the longitudinal direction.

15. The fuel feeding pipe protection structure according to claim 11, wherein the fuel feeding pipe extends in a direction perpendicular to the longitudinal direction.

16. The fuel feeding pipe protection structure according to claim 11, wherein the bolt extends in the longitudinal direction.

17. The fuel feeding pipe protection structure according to claim 11, wherein the intake manifold includes a weak portion weaker against bending force than other portion thereof, and the handle member is disposed on distal end side of the intake manifold with respect to the weak portion.

18. The fuel feeding pipe protection structure according to claim 17, wherein the weak portion is an annular groove.

19. A vehicle comprising the fuel feeding pipe protection structure according to claim 11.

* * * * *